US005954416A

United States Patent [19]

Peterson

[11] Patent Number: 5,954,416

[45] Date of Patent: Sep. 21, 1999

[54] ROTATING REFLECTOR FLASHLIGHT

[75] Inventor: Francis Peterson, Prescott, Wis.

[73] Assignee: Phillips Plastics Corporation, Prescott, Wis.

[21] Appl. No.: 09/033,766

[22] Filed: Mar. 3, 1998

[51] Int. Cl.[6] ..... F21V 21/30

[52] U.S. Cl. ..... 362/35; 362/187; 362/284; 362/324

[58] Field of Search ..... 362/35, 187, 284, 362/324, 346, 298

[56] References Cited

U.S. PATENT DOCUMENTS

| | | | |
|---|---|---|---|
| 2,947,851 | 8/1960 | Lozeau . | |
| 4,104,615 | 8/1978 | Hunter | 362/35 X |
| 4,249,234 | 2/1981 | Park et al. | 362/228 |
| 4,274,130 | 6/1981 | Elliott | 362/184 |
| 4,713,736 | 12/1987 | Kasboske | 362/214 |
| 4,807,097 | 2/1989 | Gammache | 362/202 |
| 4,984,140 | 1/1991 | Ellion | 362/187 |
| 5,126,923 | 6/1992 | Hall, II | 362/35 |
| 5,367,446 | 11/1994 | Ellion | 362/184 |

*Primary Examiner*—Stephen Husar

*Attorney, Agent, or Firm*—Merchant, Gould, Smith, Edell, Welter & Schmidt, P.A.

[57] ABSTRACT

An apparatus for generating a beam of light with a perceived beam having constant brightness comprising a flashlight apparatus having a parabolically shaped reflector, and the flashlight apparatus also having a equal-sided rotating hexagon present along the axis of the reflector. The outside surfaces of the hexagon are covered with a mirror-like surface for deflecting the light rays emanating from a light source located at the focus of a reflector in a changing pattern as the hexagon rotates about its axis, which is perpendicular to the reflector axis. The changing light pattern eliminates a dark area of the beam from the flashlight as the changing pattern directs light rays across the dark area as the hexagon rotates.

21 Claims, 6 Drawing Sheets

ROTATING REFLECTOR FLASHLIGHT

FIELD OF THE INVENTION

The present invention relates to an apparatus functioning as a flashlight and more particularly, to an apparatus for providing a light source with a perceived constant brightness.

BACKGROUND OF THE INVENTION

Many embodiments of conventional flashlights employ parabolic reflectors as part of their light source to outwardly direct the light from a bulb contained therein outward toward an object that is wished to be illuminated. When the bulb is located at the focus of the paraboloid, the light rays leaving the bulb, and subsequently impacting on the surface of the reflector, will travel the same distance as they emerge parallel to axis. This arrangement results in a bright and concentrated spot beam.

Conventional flashlights are also capable of forming a broader beam by moving the light bulb relative to the paraboloid so that the bulb is no longer at the focus. The result of moving the bulb from the focus is that the light rays leaving the bulb reflect off the paraboloid surface and emerge diverging from the central axis. The broader beam formed in this manner has several deficiencies. First, the broader beam appears to be less bright by at least the increase in the beam area over the area of the spot. In addition, the broader beam has an unilluminated spot at its center. This center dark area is caused by light rays originating at a location other than the focus of the parabolic reflector. These deficiencies with the resultant broad beam creates a non-ideal illumination pattern on objects that are being viewed.

Prior attempts to eliminate unilluminated portions of a flashlight's beam of light have included flashlights constructed with complex reflectors including multiple parabola, flashlights constructed with multiple light sources and control circuitry, and flashlights constructed with a light source which moves within the reflector. Examples of flashlights which employ the above techniques are described with two patents issued to Ellison (U.S. Pat. No. 4,984,140 and U.S. Pat. No. 5,367,446). Undue complexity of said flashlight designs leads to unacceptably high manufacturing costs and lead to issues of reliability associated with their operation.

SUMMARY OF THE INVENTION

The present invention is directed to an apparatus and method for generating a beam of light with a perceived beam having constant brightness. In one particular embodiment, the present invention is directed to a light-emitting apparatus having a parabolically shaped reflector, and also having a substantially equal-sided rotating polygon present along the axis of the reflector. The outside surfaces of the polygon are covered with a mirror-like surface for deflecting the light rays emanating from a light source located at the focus of a reflector in a changing pattern as the polygon rotates about its axis, which is substantially perpendicular to the reflector axis. As the polygon rotates, the changing light pattern minimizes a dark area of the beam from the flashlight as the changing pattern directs light rays across the dark area.

BRIEF DESCRIPTION OF ILLUSTRATED DRAWINGS

The invention may be more quickly understood in consideration of a detailed description of various embodiments of the present invention which follow in connection with the accompanying drawings, in which.

Figure 1:
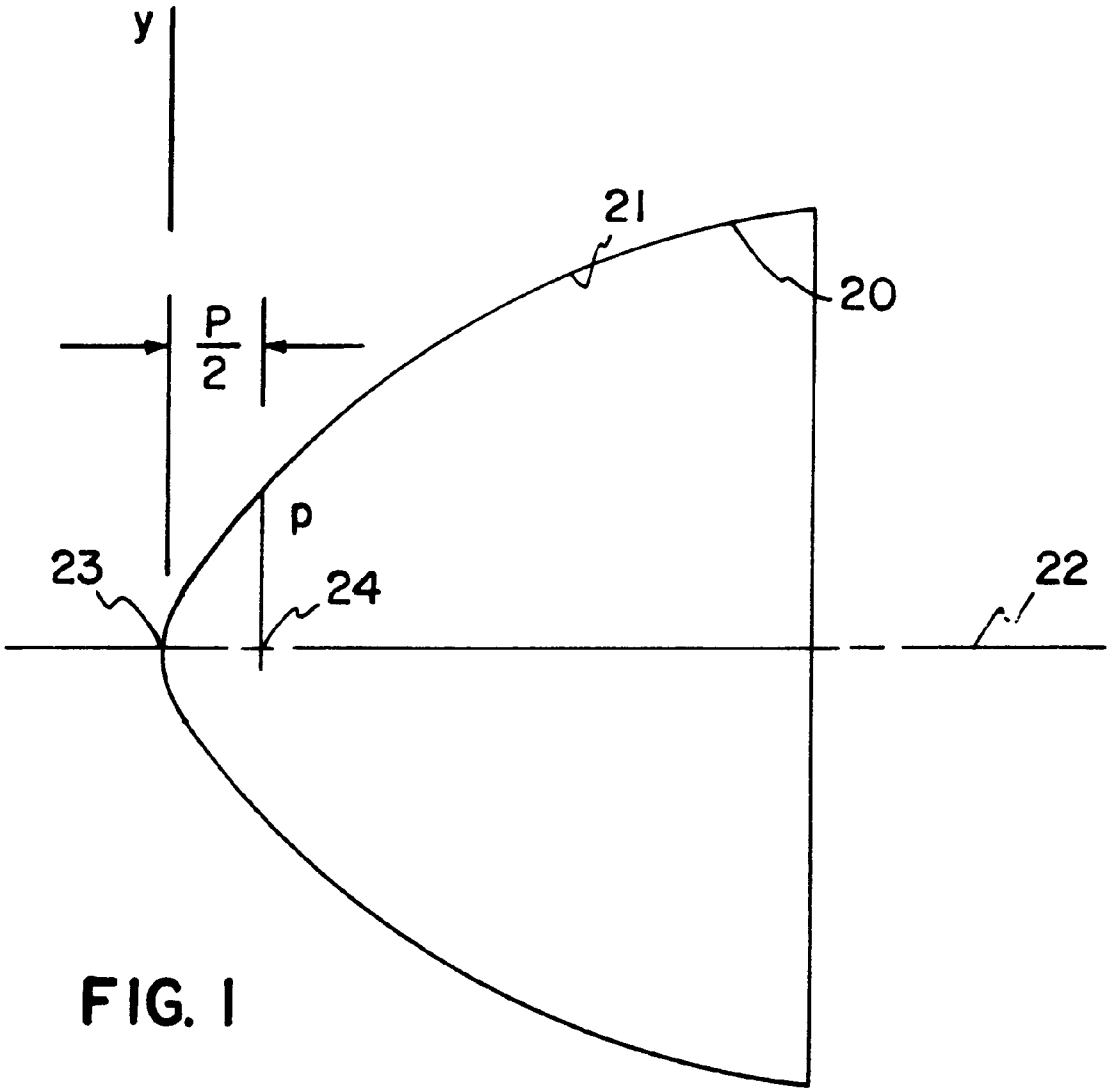
FIG. 1 is an axial cross section of a parabolic showing the definitive geometry of the parabola, which is used to illustrate an example embodiment according to the present invention.

While the invention is amenable to various modifications in alternative forms, specifics thereof have been shown by way of example in the drawings and will be described in detail. It should be understood, however, that the intention is not to limit the invention to the particular embodiments described. On the contrary, the intention is to cover all modifications, equivalents, and alternatives falling within the spirit and scope of the invention as defined by the appended claims.

DETAILED DESCRIPTION OF THE ILLUSTRATED EMBODIMENT

The present invention is believed to be applicable to a variety of systems and arrangements in which a directional light source is capable of illuminating a variable sized spot. The invention has been found to be particularly advantageous in application environments where a light-emitting apparatus contains a light source which permits a broadening and narrowing of the light beam to increase or decrease the size of the spot illuminated. While the present invention is not so limited, an appreciation of various aspects of the invention is best gained through a discussion of application examples operating in such an environment. In the immediate discussion that follows, the example light source described is a hand-held flashlight.

Turning now to the drawings, FIG. 1 is an axial cross-section view of a reflector having a two-dimensional planar parabola 20. A paraboloid is formed by a three dimensional surface of revolution creating a parabola rotated about its axis. Reflecting surface 21 of the parabola is defined by the equation $y^2=2px$, where y is measured laterally from the axis of symmetry 22 and x is measured from the apex 23 of the parabola. The constant p is the value of y at the focus 24.

Figure 2:
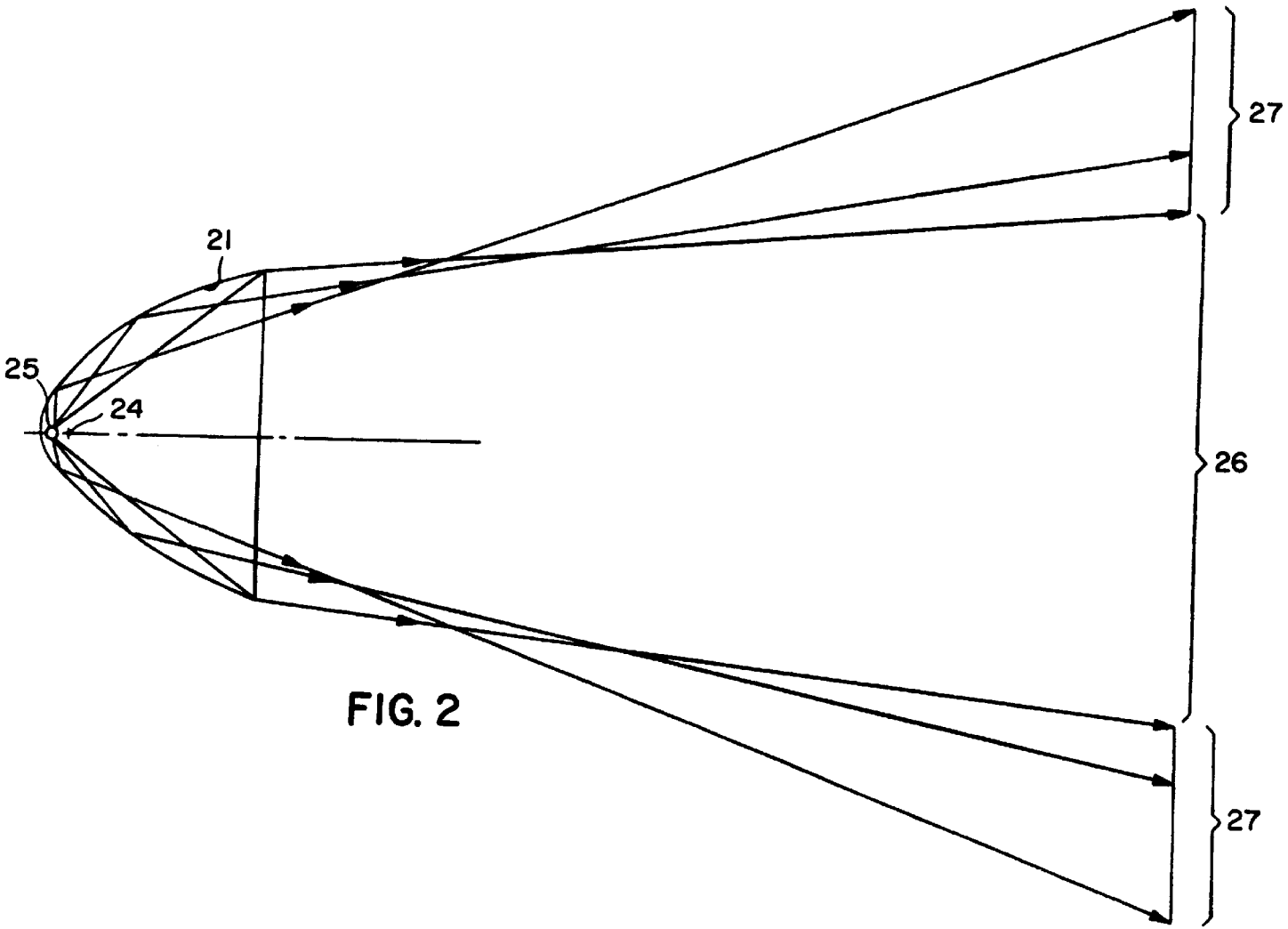
FIG. 2 is a geometric drawing showing the light pattern generated by a paraboloid when the light source is between the focus and the reflector.
Figure 3:
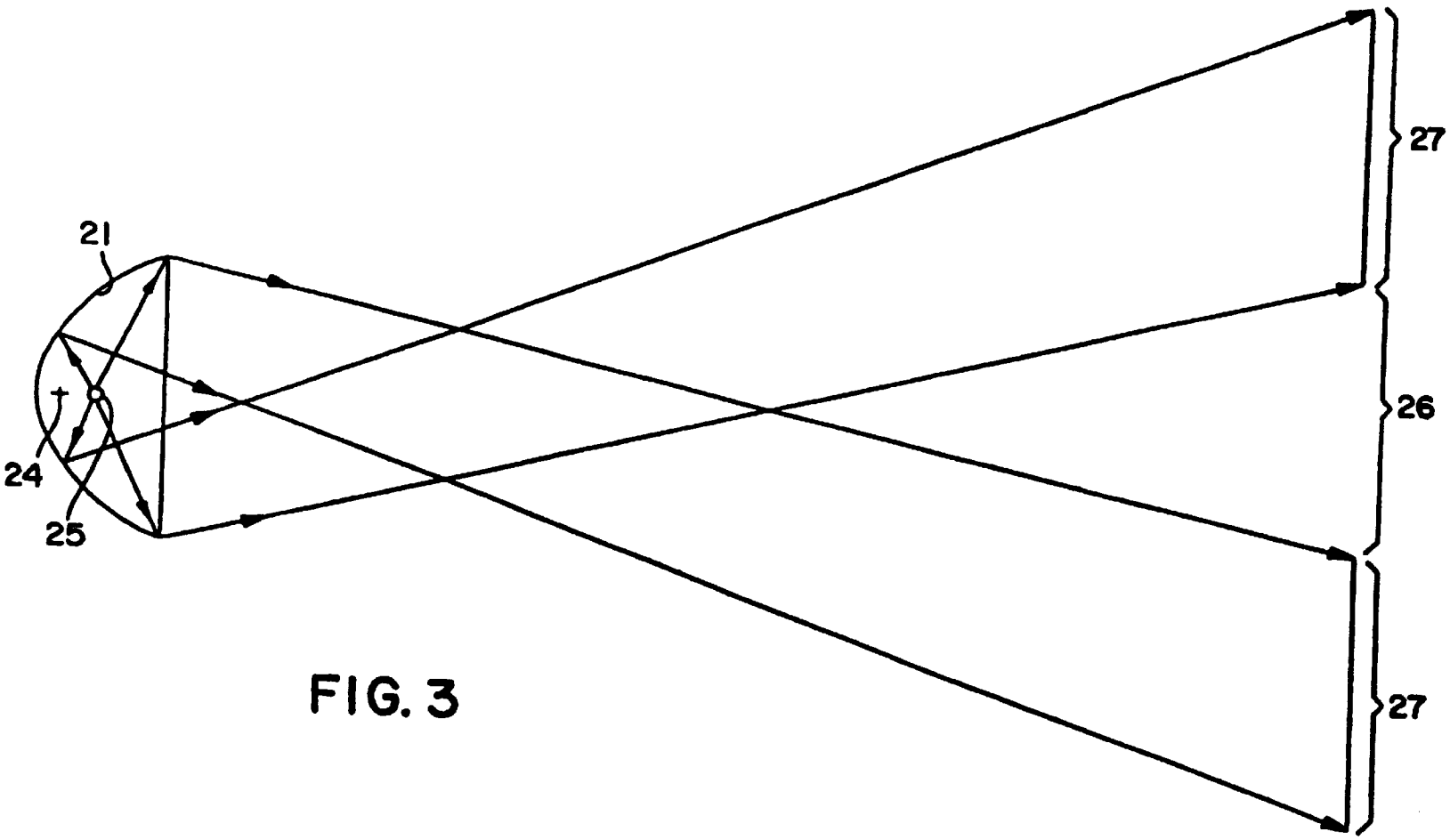
FIG. 3 is a geometric drawing showing the light pattern generated when the light source is located on the other side of the focus from the reflector.

For a polished surface, the angle of reflection of any light ray is equal to the angle of incidence. It is well-known that a polished reflecting surface shaped as a paraboloid projects a spot beam of parallel light rays when the bulb is at the focus. One common technique for controlling the size of a flashlight beam is to move the light bulb relative to the focus of a fixed parabolic reflector, or the reflector relative to a fixed bulb. When the bulb is located at the focus of the paraboloid, all reflected light rays will travel in parallel paths to form a spot beam. However, if the bulb is moved axially off of the focus either toward the reflector or away from it, this relationship no longer holds. The rays are then reflected from the bulb either in a diverging fashion away from the axis of the parabola if the bulb is at a value of x that is less than p/2, or in a fashion that crosses over the axis if the bulb is at a value of x that is greater than p/2. FIGS. 2 and 3 illustrate these conditions, relative to the paraboloid of FIG. 1.

In FIGS. 2 and 3, the light source 25 is shown axially displaced from focus 24. An unilluminated circular region 26 occurs in both cases at the center of the area to which the flashlight is pointing, in the center of an illuminated annular ring 27. This dark region is precisely at the center of the area the user wishes to illuminate and consequently is highly undesirable. The size of the dark spot is defined by the light having the minimum deflection angle from the center line of the paraboloid. The light reflected from the parabolic surface at the maximum value of y when the bulb is located as in FIG. 2 or from the minimum value of y when the bulb is located as in FIG. 3. As such, the size of the dark spot is a function of the displacement of the bulb relative to the focus. The actual size varies linearly with the distance to the object being illuminated. In a typical flashlight, this unilluminated spot is approximately one-quarter of the broad beam area.

Figure 4:
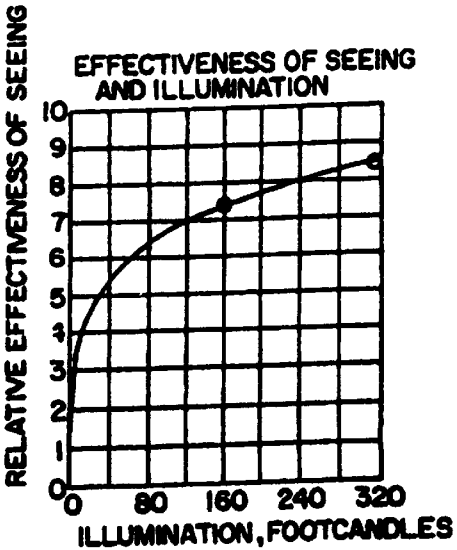
FIG. 4 is a graph showing the relationship between perceived or apparent brightness and actual brightness.

The present invention utilizes various characteristics of the human eye related to the image perceived from pulses of light of various intensities repeated at a fixed rate. These characteristics are summarized herein. These characteristics are discussed in greater detail in Ellison, U.S. Pat. Nos. 4,984,140, and 5,367,446, which are incorporated by reference. In its simplest form, the eye functions similar to a camera: a lens to form the image from the entering light waves, an iris to regulate the amount of light, and the retina that is sensitive to light for recording the image. After the light hits the light sensitive retina, the stimulation's are carried by the optic nerve to the visual cortex area in the rear of the brain. The apparent intensity that the observer experiences is not a linear function of the actual intensity but varies in a logarithmic fashion. Examination of the curve in FIG. 4 shows that a decrease of 50 percent in the light intensity will result in apparent reduction in perceived brightness of only 12 percent.

The brain does not perceive a light immediately upon impact upon the retina. Similarly, an after-image is perceived when a light terminates. It is this after image effect that makes movements in a motion picture or a television image appear to be smooth and continuous in spite of the fact that they are composed of a series of images that are flashing at a fixed frame rate.

Flicker is defined as the sensation of an observer when a source of light is turned on and off at relatively slow speeds. At extremely slow speeds, the observer sees definite dark and light flashes, and at higher speeds the observer experiences no sensation of changes in light intensity. The flashing rate where there is no sensation of change is called the critical fusion frequency (cff). At high levels of illumination, the cff required may be 60 Hz hertz while for lower levels of illumination the cff may only be 4 Hz. As a result, if an observer is shown a low intensity flash followed by darkness for up to ¼ second before the next flash, the observer will not experience may sense of a flickering light. The same observer, however, who is shown a high intensity flash followed by the same darkness period, would definite bright and dark flashes.

Figure 5:
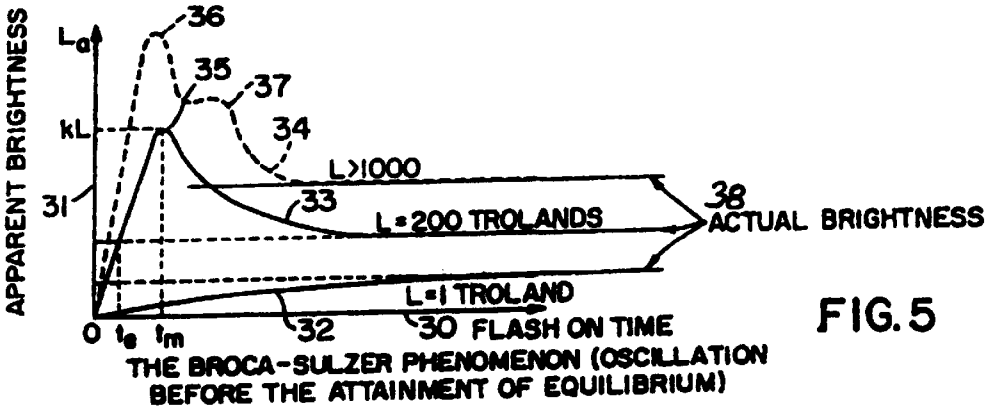
FIG. 5 is a graph showing the relationship between perceived or apparent brightness and actual brightness for a short pulse of light.

FIG. 5 illustrates several facets of this phenomenon. The abscissa 30 of FIG. 5 represents the flash "on-time" of a light pulse. The horizontal asymptotic lines 38 is the actual brightness. The ordinate 31 is the apparent or perceived brightness. Curves 32, 33 and 34 represent the apparent brightness perceived by a flash of respectively low actual brightness of approximately 1 troland, a medium brightness of approximately 200 trolands, and a substantial brightness of over about 1,000 trolands. In each case, the perceived brightness finally becomes identical to the actual brightness. The initial perceived brightness is quite different. At the low level of curve 32, the perceived brightness does not equal the actual brightness until a substantial time interval.

Peak 35 on curve 33, and peaks 36, 37 on curve 32 which are caused by substantial illumination levels, demonstrate an early quite large perceived brilliance, substantially in excess of the actual brightness, and the perceived brightness remains higher than the actual brightness for a substantial period of time. This phenomenon presents an opportunity to amplify the perceived brilliance of a given light source.

A similar effect for a train of flashes has shown that a slowly flashing light will produce an apparent brightness considerably greater than the same light at either steady illumination or at frequencies greatly exceeding the critical fusion frequency. The greatest effect was observed at a flashing rate of 10 hertz and for a flash that was on about 25 percent of the time.

A flashing light at certain frequencies and specific levels of luminance will appear steady, and will also appear considerably brighter, than a steady light of the same intensity. It is now possible to describe example embodiments of the invention that employs the use of these phenomena together with the unique reflector apparatus according to the present invention which produces a beam without dark spots or rings.

As previously stated, FIGS. 2 and 3 illustrate a conventional parabolic reflector with the light bulb displaceable from the focus. It has been shown above that the resulting broad beam would have a dark spot 26 in the critical center area. Illuminated ring 27 is a bright ring. In order to show how an example reflector apparatus according to the present invention can eliminate the dark region of the broad beam and still not degrade the bright spot beam, it will be helpful to present some actual dimensions for a flashlight reflector.

A typical flashlight employs a conventional parabolic reflector having a minimum diameter of 0.600 inch to accommodate the light bulb and a convenient maximum diameter of two inches or more. The light bulb is displaced about 0.2 inches in order to change the spot to a broad beam.

When the bulb is moved either way from the focus, a dark spot will appear in the center of the beam. Inspection of the ray traces in FIGS. 2 and 3 show how this occurs. A flashlight constructed with a simple parabolic reflector having a broader beam has a dark center spot. In fact, a conventional 2 inch diameter parabolic reflector which projects a good beam when the light bulb is at the focus, can have a dark spot as great as 5 feet in diameter at 20 feet when the light bulb is displaced from the focus by about 0.2 inches.

Therefore, diameter of the parabolic reflector produces the illumination for the outer circumference of the broad beam. Since it is desirable to have a broad beam, it is not necessary to change the reflector surface. However, it is also desirable to direct some of the light from the bulb so as to illuminate the center of the broad beam out to the edge of the dark spot.

Figure 6:
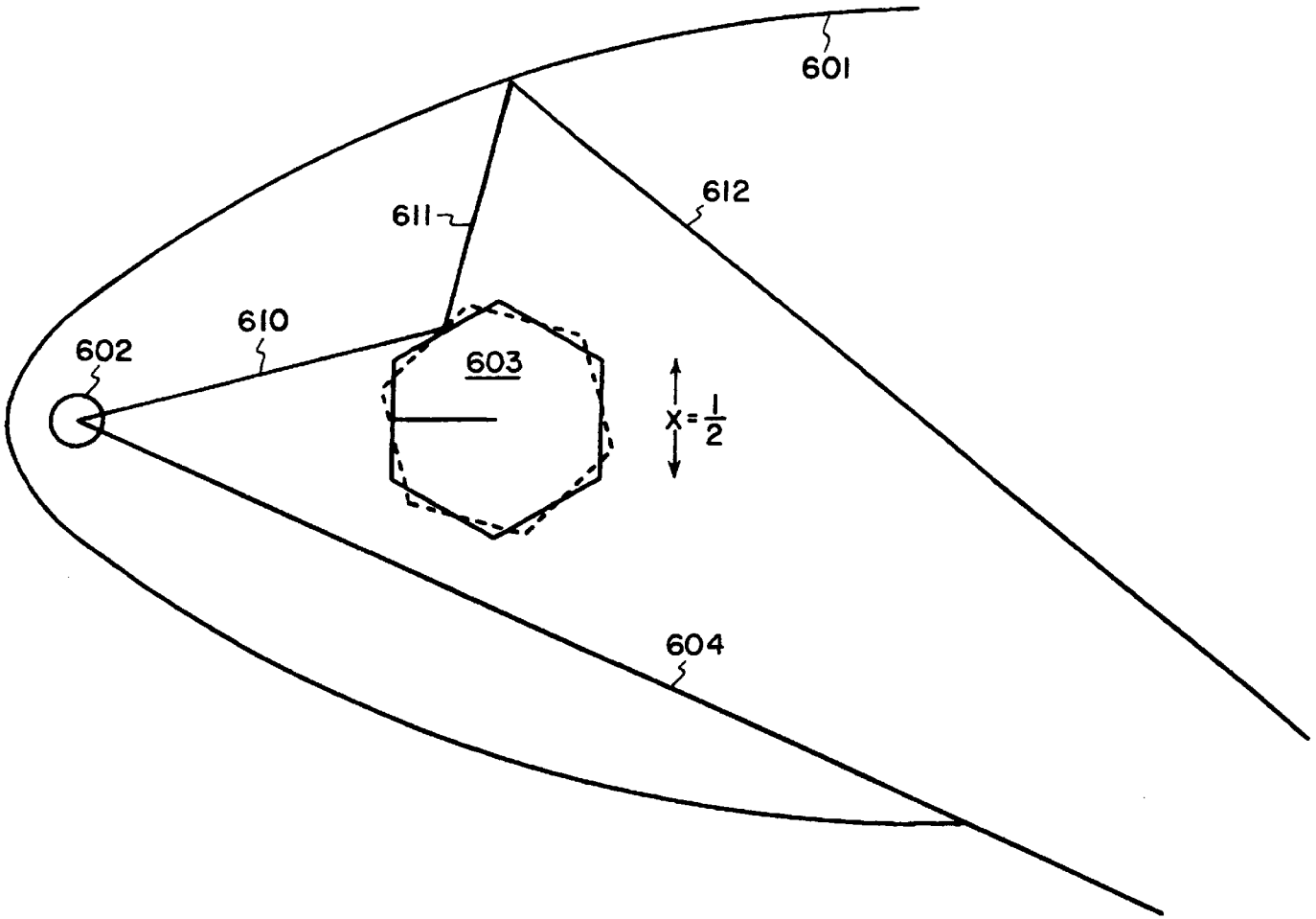
FIG. 6 is an example embodiment according to the present invention of a light pattern generated from a light source.

FIG. 6 is a two dimensional diagram of one embodiment of a flashlight reflector according to the present invention.

The flashlight includes of a parabolic reflector 601 with a light source 602 at its focus. Located on the center axis of the reflector is a rotating hexagon 603 having substantially equal length sides. The outside surfaces of this rotating hexagon are constructed of a mirror-like surface to reflect the rays of light received from the light source 602. When the flashlight is in operation, light rays emanate from the light source as was previously discussed in FIGS. 2 and 3. The light rays which do not strike the rotating hexagon behave in the same fashion discussed in FIGS. 2 and 3 as shown by light ray 604. Light rays directed towards the center of the reflector strike the reflecting surfaces of the hexagon which deflects the light path as shown in FIG. 6. The light ray 610 which leaves the light source 602 and strikes the hexagon 603 reflects upward towards the outside of the reflector. This light ray 611 then reflects off the surface of reflector 601 creating a reflected light ray 612 which is directed outward towards the object to be illuminated. As the hexagon 603 rotates about its axis, the angle of incidence of the light striking the surface of the hexagon changes. This rotation causes the light ray reflecting off of the hexagon surface 611 to have a changing angle of reflection. As the reflective light ray 611 strikes the reflector 601, its corresponding angle of incidence to the reflector 601 also changes. This changing angle of incidence with reflector 601 causes the angle of reflection for the final light ray 612 to change. These changing angles of reflection moves the light ray 612 up and down the object being illuminated.

As the rotating hexagon 603 causes the light rays directed towards the center of the broad light beam to be illuminated at a rate related to the rate of rotation of the hexagon. This sweeping of the light rays across the dark spot, when occurring at an appropriate frequency relative to the cff for the flashlight, creates a perception of a fully illuminated broad spot.

In one embodiment according of the present invention, dimensions of the flashlight reflector are approximately 3" by 2" by 1¼". The light source is located along the central access of the reflector at a distance approximately 1 to 1½" from its central point. The center of the rotating hexagon is also located along the central access of the reflector at a distance approximately from the center point. The hexagon rotates through a circle having a diameter of approximately one-half inch. While the above embodiment utilizes a hexagon, any multi-sided polygon could be substituted in the above description without changing the nature and operation of the present invention.

Figure 7:
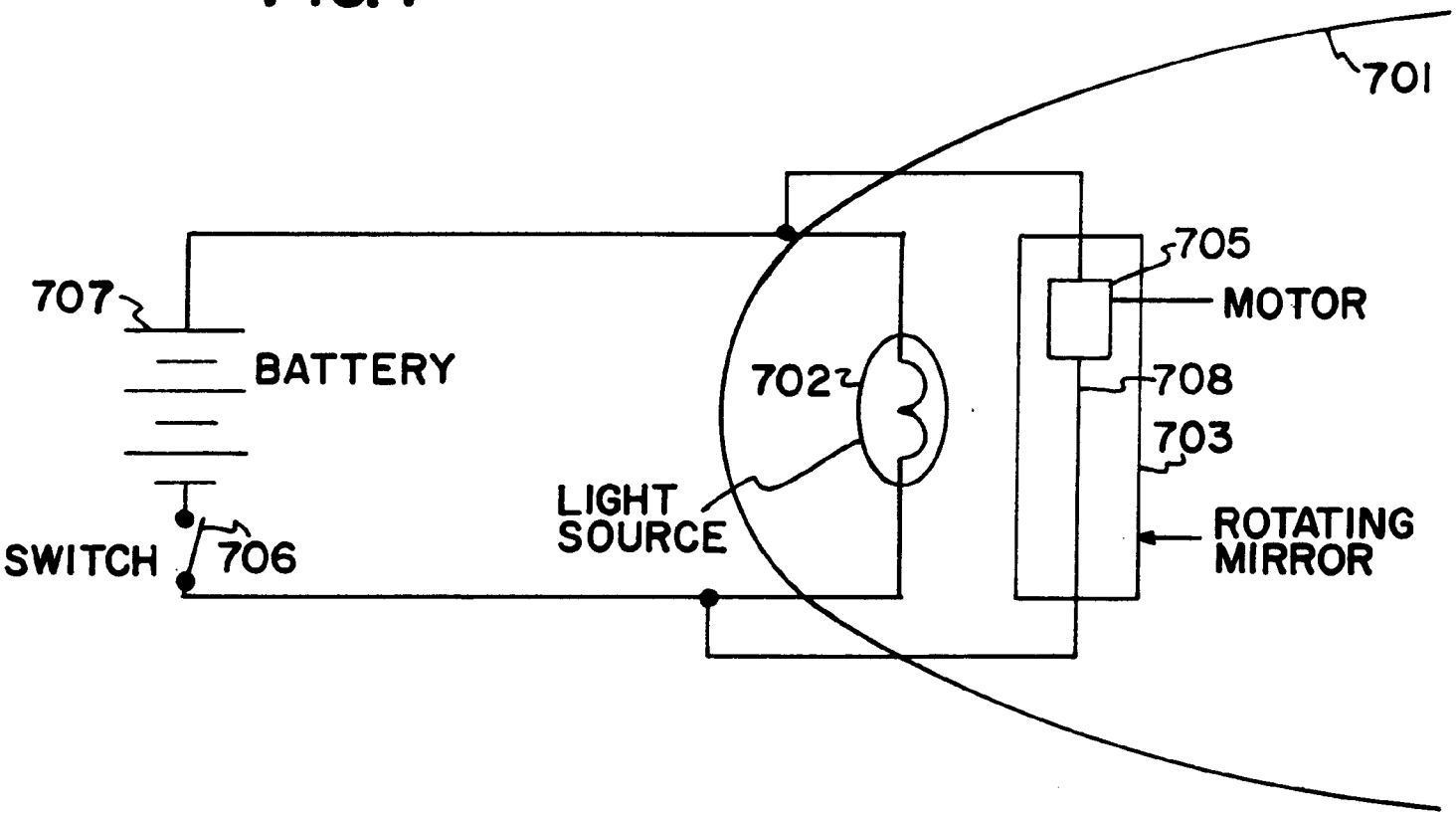
FIG. 7 is an electrical schematic of another example embodiment according to the present invention.

FIG. 7 is a schematic diagram of an example embodiment according to the present invention. A circuit consists of a light source 702 located within the reflector 701 as previously discussed. The light source is connected in series with a switch 706 and a battery 707 or other power source to provide the electrical current needed to power the light source. The rotating reflector unit 703 is attached to a shaft 708 of a motor 705 which is electrically connected in parallel with the light source 702. In this arrangement, the motor is activated, and the light source is illuminated, by closing switch 706. A portion of the motor 705 is physically attached to the sides of the reflector 701 permitting the hexagon to rotate about the axis of the motor as its shaft 708 rotates. In this embodiment, the motor causes the rotating hexagon mirror unit to rotate at a rate of approximately 1000 rpm with a possible range of rates between 600 and 2000 rpm.

The various embodiments described above are provided by way of illustration only and should not be construed to limit the invention. Those skilled in the art will readily recognize various modifications and changes which may be made to the present invention without strictly following the exemplary embodiments and applications illustrated and described herein, and without departing from the true spirit and scope of the present invention which is set forth in the following claims.

I claim:

1. A light-emitting apparatus for providing a light beam for minimizing unilluminated regions of a generated beam of light comprising:

a parabolically shaped reflector having an apex, a central axis, and a focus;

a light source located at the focus of the reflector; and a reflective, multi-sided polygon located in front of the light source along the central axis of the reflector, wherein the polygon rotates about its longitudinal axis, wherein the longitudinal axis of the polygon is perpendicular to the central axis of the reflector.

2. A light-emitting apparatus according to claim 1, further comprising a battery coupled to a light source to provide power to the light source.

3. A light-emitting apparatus according to claim 1, wherein the multi-sided polygon is a hexagon.

4. A light-emitting apparatus according to claim 3, wherein the reflective , multi-sided polygon is constructed with mirrors.

5. A light-emitting apparatus according to claim 1, wherein the polygon rotates above its longitudinal at a constant rate between 600–2000 Hz.

6. A light-emitting apparatus according to claim 1, wherein light source comprises a single light bulb.

7. A light-emitting apparatus according to claim 5, wherein the constant rate of rotation for the mirrored hexagon can be set to a selected rate between 600–2000 Hz.

8. A method for providing a light beam from a flashlight with a parabolically shaped reflector having an apex, a central axis, and a focus for minimizing the regions of a produced beam of light comprising:

illuminating a light source located at the focus of the reflector;

locating a reflective, multi-sided polygon located in front of the light source along the central axis of the reflector; and rotating the polygon about its longitudinal axis, wherein the longitudinal axis of the hexagon is perpendicular to the central axis of the reflector.

9. A method according to claim 8, wherein the light source is battery powered.

10. A method according to claim 8, wherein the polygon is a hexagon.

11. A method according to claim 8, wherein the reflective sides of the polygon are constructed using mirrors.

12. A method according to claim 8, wherein the mirrored hexagon rotates above its longitudinal at a constant rate between 600–2000 Hz.

13. A method according to claim 8, wherein light source comprises a single light bulb.

14. A method according to claim 12, wherein the constant rate of rotation for the mirrored hexagon can be set to a selected rate between 2–10 Hz.

15. An apparatus for providing a light beam from a flashlight with a parabolically shaped reflector having an apex, a central axis, and a focus having no unilluminated regions comprising:

means for illuminating a light source located at the focus of the reflector;

means for locating a mirrored hexagon located directly in front of the light source along the central axis of the reflector; and means for rotating the mirrored hexagon at a fixed rate about its longitudinal axis, wherein the longitudinal axis of the hexagon is perpendicular to the central axis of the reflector.

16. An apparatus according to claim 15, wherein the light source is battery powered.

17. An apparatus according to claim 15, wherein the light source is powered by an AC voltage.

18. An apparatus according to claim 15, wherein the light source is powered by an DC voltage.

19. An apparatus according to claim 15, wherein the mirrored hexagon rotates above its longitudinal at a constant rate between 600–2000 Hz.

20. An apparatus according to claim 15, wherein light source comprises a single light bulb.

21. An apparatus according to claim 19, wherein the constant rate of rotation for the mirrored hexagon can be set to a selected rate between 600–2000 Hz.

* * * * *